US005469965A

United States Patent [19]

Stearns

[11] Patent Number: 5,469,965

[45] Date of Patent: Nov. 28, 1995

[54] VIDEO CASSETTE MAILERS

[76] Inventor: Gary E. Stearns, 36W418 Huntley Rd., Dundee, Ill. 60118

[21] Appl. No.: 138,286

[22] Filed: Oct. 18, 1993

Related U.S. Application Data

[63] Continuation of Ser. No. 727,490, Jul. 9, 1991, abandoned.

[51] Int. Cl.[6] ..... B65D 85/672

[52] U.S. Cl. ..... 206/387.1; 206/588; 206/523; 229/87.02; 229/92.8

[58] Field of Search ..... 206/387.1, 387.11, 206/491, 588, 523; 229/87.01, 87.02, 92, 92.8

[56] References Cited

U.S. PATENT DOCUMENTS 4,838,420 6/1989 Collett et al. ..... 206/387.1

5,078,268 1/1992 Olson et al. ..... 206/387.1

5,232,087 8/1993 Schluger ..... 206/387.1 X

*Primary Examiner*—Jacob K. Ackun

*Attorney, Agent, or Firm*—Kajane McManus

[57] ABSTRACT

The video cassette mailer comprises a box which is foldable from a prescored blank and includes a structure therein for securely isolating at least one video cassette from any damage which it may incur during mailing. The isolating structure is configured to fit snugly within the box and securely engage the video cassette. The isolating structure includes a wall which rests against and cushions one planar surface of the cassette while the box includes a plurality of foldable panels, tabs and cover sections which seat against and cushion the opposite side of the cassette, with the isolating structure protecting at least the short side walls and corners of the cassette.

33 Claims, 6 Drawing Sheets

VIDEO CASSETTE MAILERS

CROSS REFERENCE TO RELATED APPLICATION

This application is a continuation of U.S. application Ser. No. 07/727,490, filed Jul. 9, 1991, now abandoned.

BACKGROUND OF THE INVENTION

The present invention relates to a mailing case for at least one video cassette, and more particularly to a mailing case in the form of a box which includes structure to protect the cassette from damage, as well as including significant surface area for receipt of descriptive elements thereon.

PRIOR ART

Heretofore, various embodiments of mailers have been proposed for use in the mailing of video cassettes, such cassettes having become a popular means of advertising for products and services. Such mailers have included padded envelopes as well as glove-like sleeves for the cassettes.

These mailers have been found to be lacking with regard to protection of the cassettes from damage incurred in the mailing of same.

As will be described in greater detail hereinafter, the mailers of the present invention offer secure engagement of at least one video cassette therein in a manner protecting the cassette from damage which may be incurred during mailing of same, with the unique configuration of the blank for the mailer offering significant surface area for receipt of printed material thereon.

SUMMARY OF THE INVENTION

According to the invention there is provided a video cassette mailer comprising a box foldable from a prescored blank. Within this box is received an isolating structure which is provided to cushion one planar surface of at least one video cassette, as well as to securely seat against short side walls of the cassette, protecting them and thus the corners of the cassette. The box is provided with foldable tabs and cover sections which engage over an opposite planar surface of the cassette, cushioning same against damage.

BRIEF DESCRIPTION OF THE DRAWINGS

Other objects and advantages of the invention will become more apparent upon perusal of the detailed description thereof and upon inspection of the drawings in which.

DESCRIPTION OF THE PREFERRED EMBODIMENTS

Figure 1:
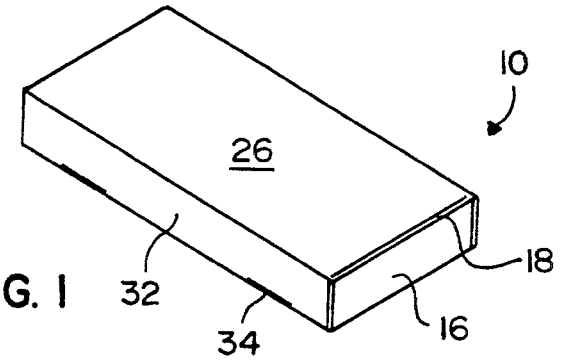
FIG. 1 is a perspective view of one embodiment of a video cassette mailer of the present invention.

Referring now to the drawings in greater detail, there is illustrated in FIGS. 1–4 a first, simple embodiment of a video cassette mailer 10 made in accordance with the teachings of the present invention.

Figure 2:
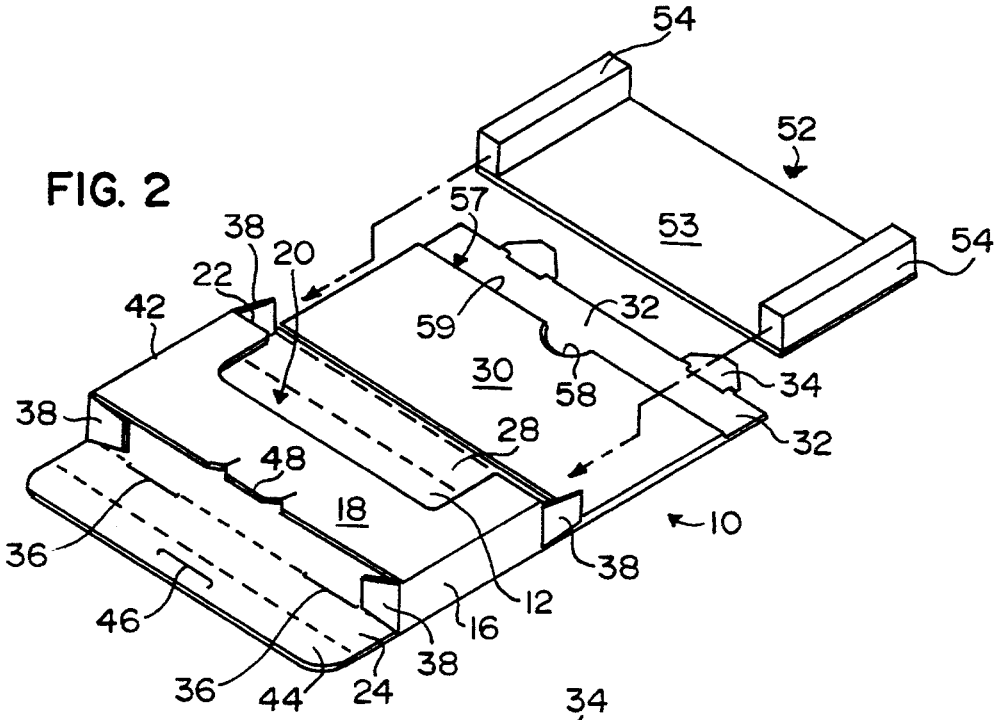
FIG. 2 is a perspective view of the cassette of FIG. 1 partially assembled and shows an isolator element thereof.
Figure 3:
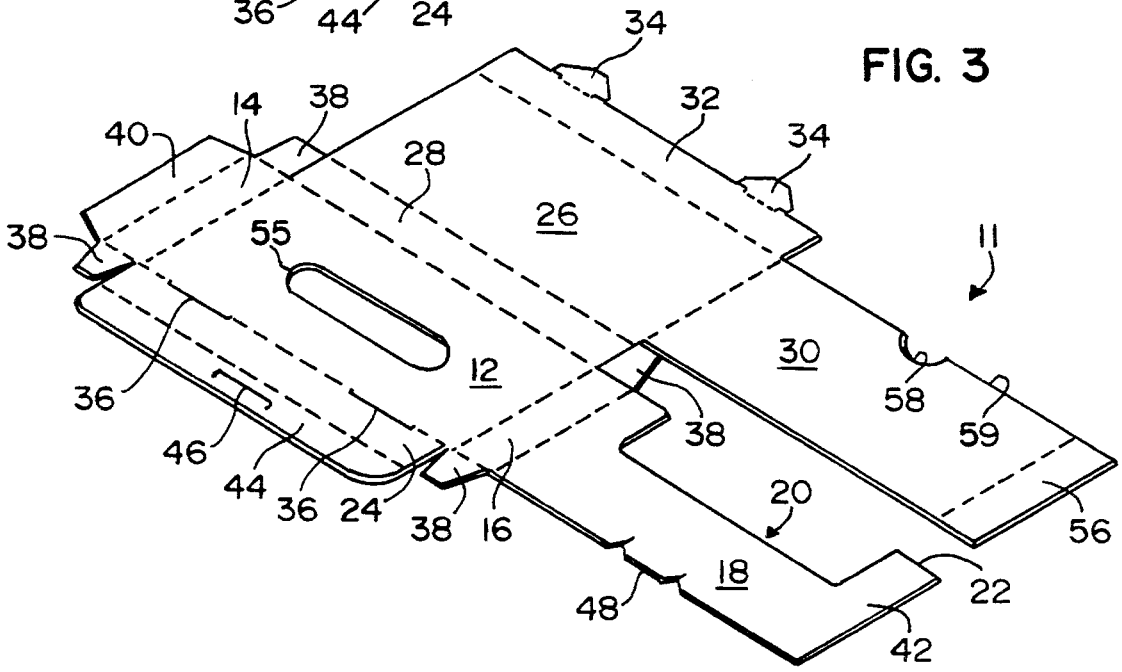
FIG. 3 is a perspective view of a blank from which the cassette of FIG. 1 is formed.
Figure 4:
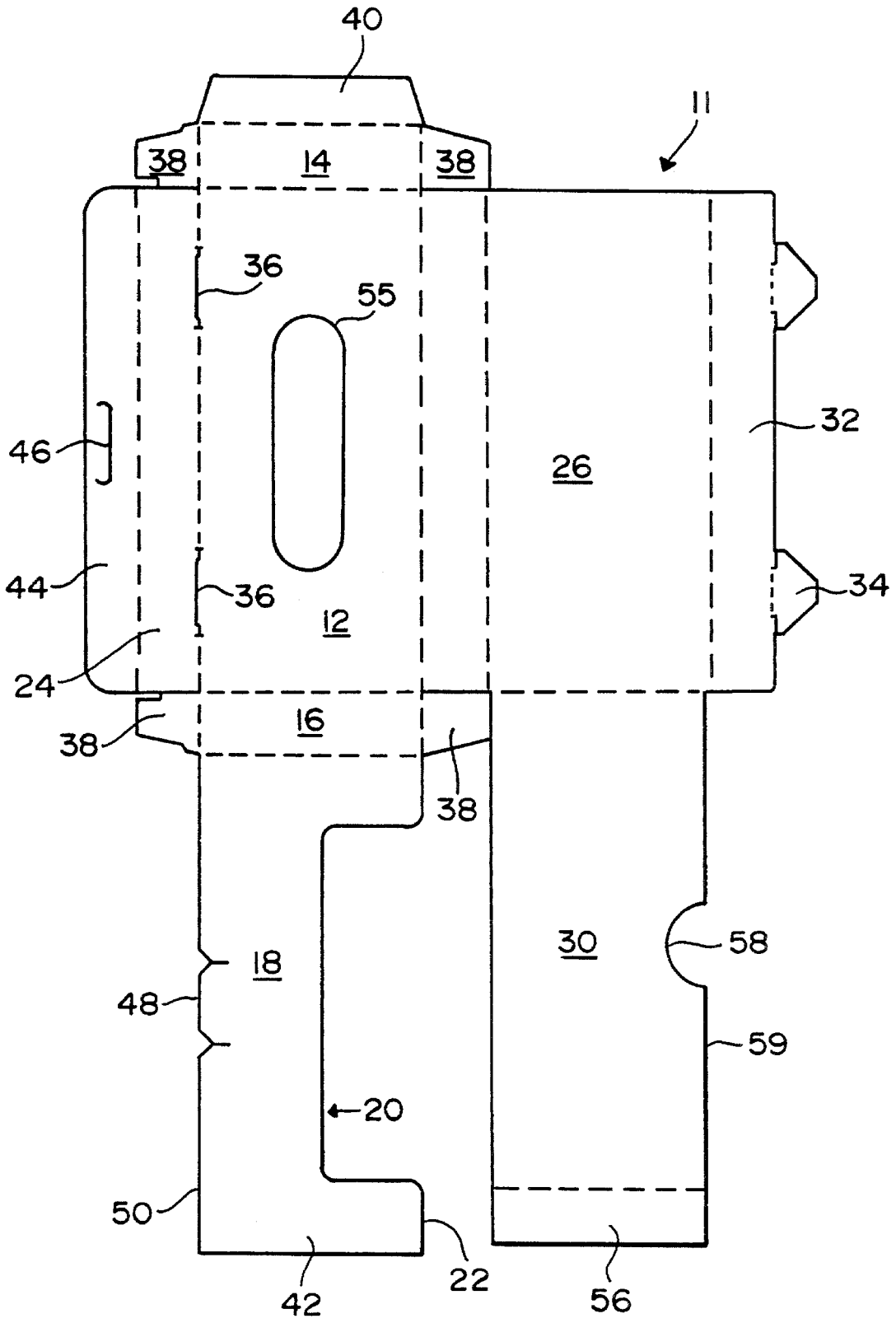
FIG. 4 is a plan view of the blank of FIG. 3.
Figure 5:
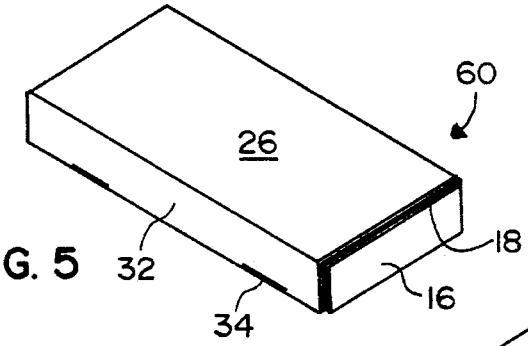
FIG. 5 is a perspective view of a video cassette mailer similar to that of FIG. 1, but slightly more complex.
Figure 6:
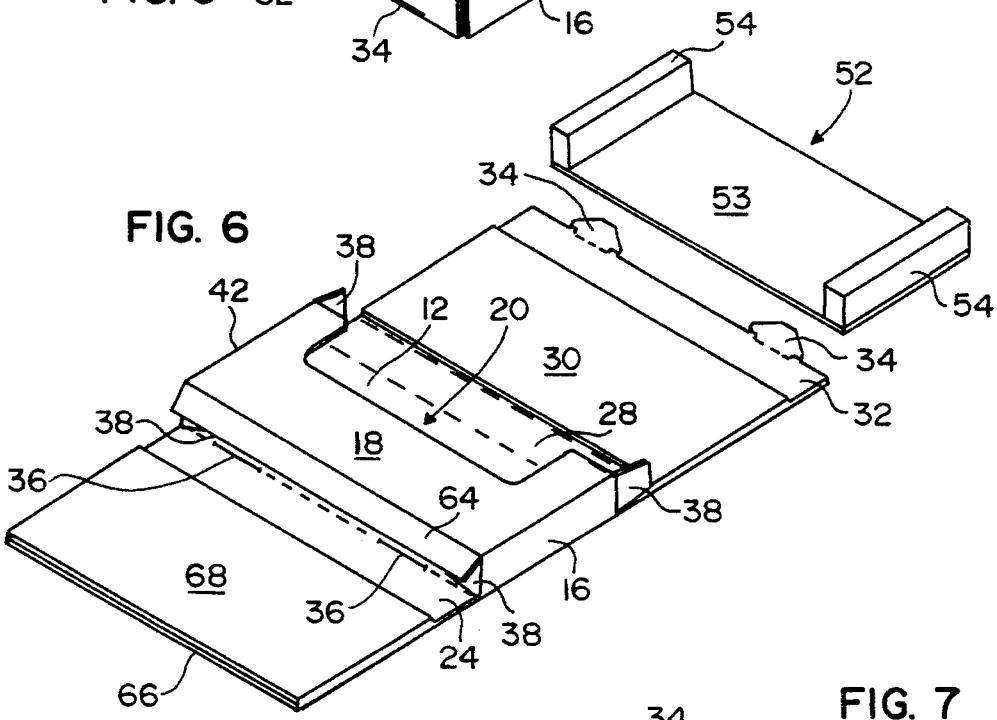
FIG. 6 is a perspective view of the mailer of FIG. 5 partly assembled and shows a the provision of a second cover member and foldable tab thereof.
Figure 7:
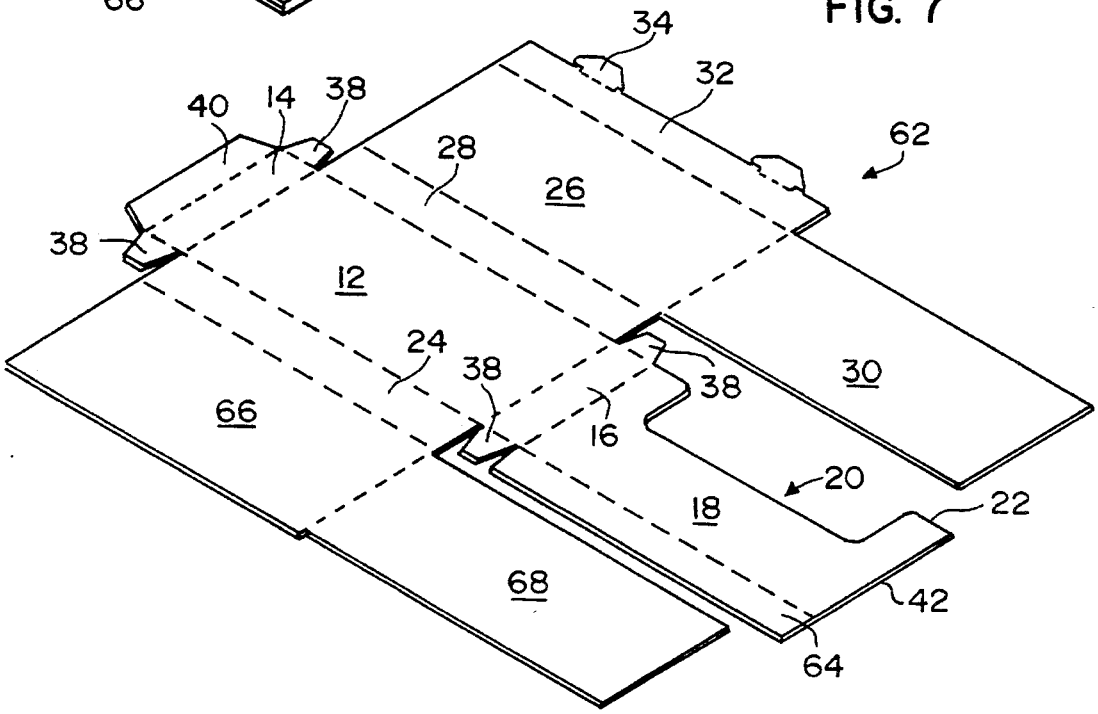
FIG. 7 is a perspective view of the blank from which the mailer of FIG. 5 is formed.
Figure 8:
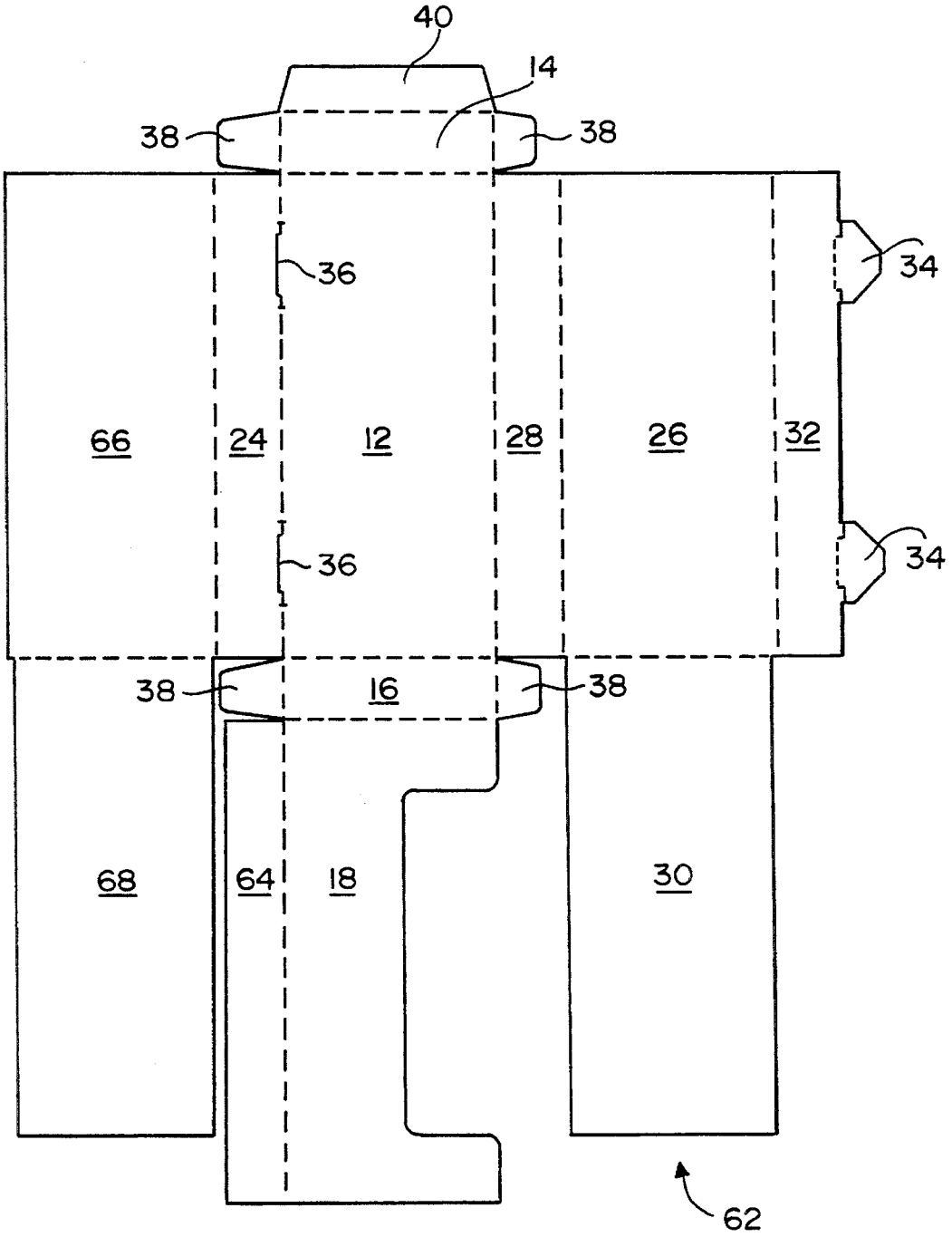
FIG. 8 is a plan view of the blank of FIG. 7.
Figure 9:
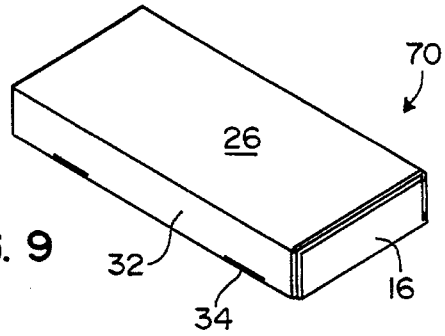
FIG. 9 is a perspective view of a further more complex version of a mailer, similar to that of FIG. 5 but further including a postcard forming foldable tab.
Figure 10:
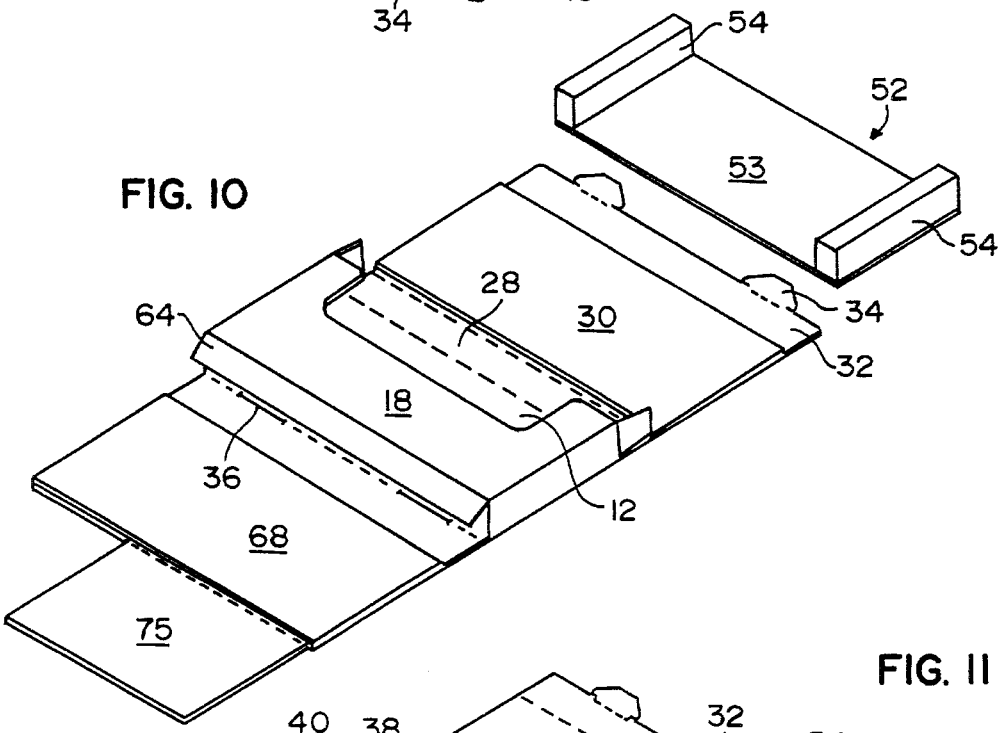
FIG. 10 is a perspective view of the mailer of FIG. 9 shown partially assembled.
Figure 11:
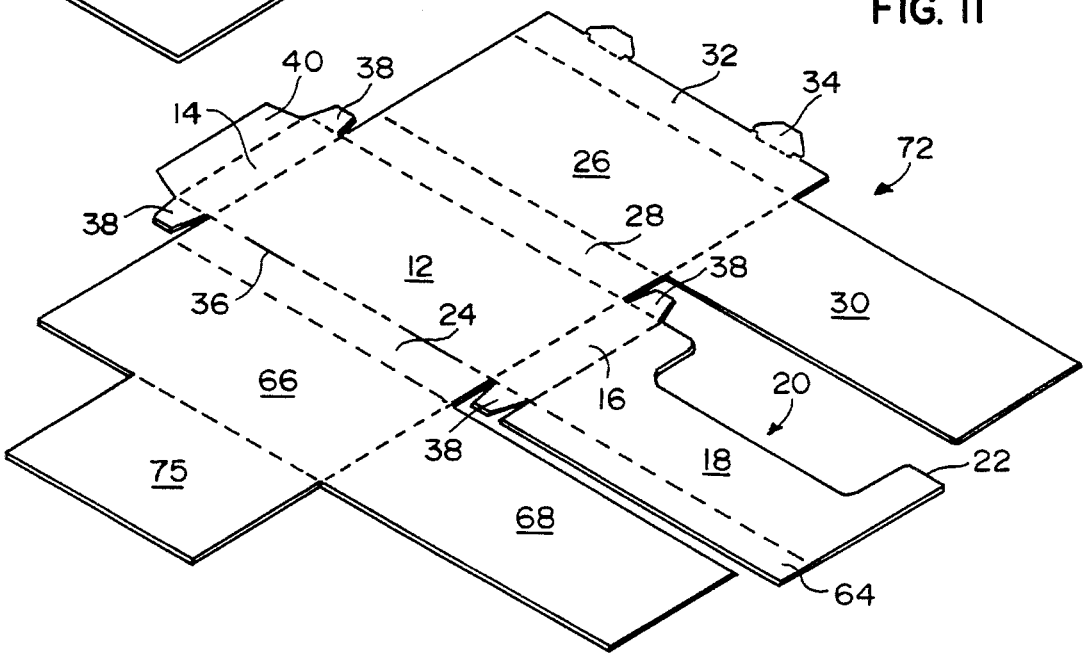
FIG. 11 is a perspective view of a blank from which the mailer of FIG. 9 is formed.
Figure 12:
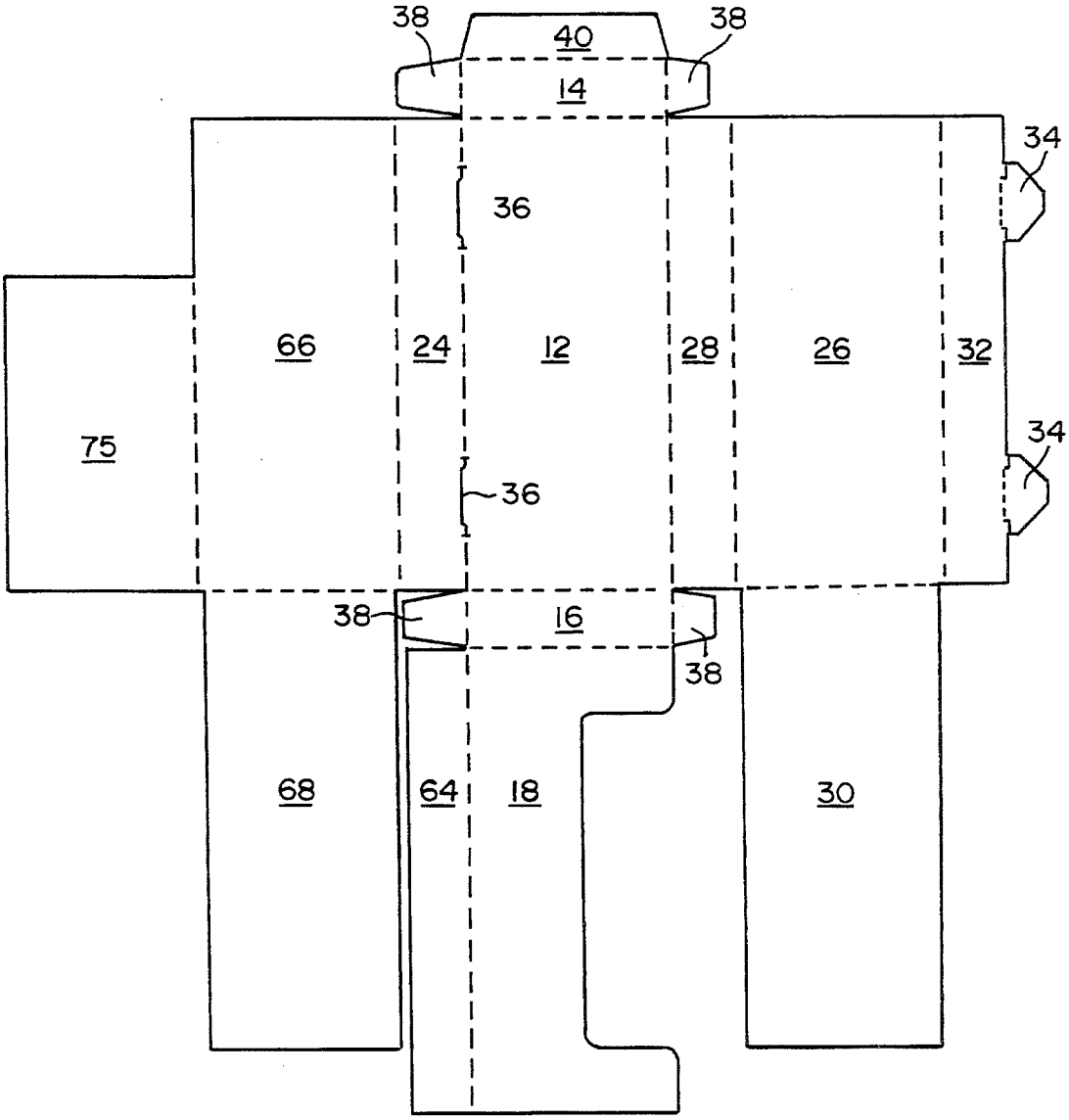
FIG. 12 is a plan view of the blank of FIG. 11.

FIG. 1 shows the mailer 10 in its constructed, closed form, while FIG. 2 shows the mailer 10 in the process of being folded from a blank 11 therefor shown in FIGS. 3 and 4.

As shown, the mailer 10 is configured to be a box 10 which includes a back panel 12, opposed first and second side panels 14 and 16 extending a predetermined distance from the back panel 12, a front panel 18 including a recessed area 20 along one elongate edge 22 thereof, a bottom panel 24, and a cover panel 26 which is engaged to the back panel 12 by a top panel 28. The cover panel 26 includes a side flap 30 which is foldable thereover and further includes a terminal flap 32 having a width equal to the width of the bottom panel 24. A plurality of tabs 34 extend from the terminal flap 32, the tabs 34 being engageable within corresponding slits 36 provided for same at the junction of the back panel 12 with the bottom panel 24.

Each side panel 14, 16 includes two lateral flaps 38 which fold inwardly and are disposed between the front panel 18 and back panel 12 when the side panels 14 and 16 are folded for engagement to the front panel 18.

One side panel 14 includes a terminal panel 40 which folds under a free end 42 of front flap 18 and engages thereto by gluing.

Then, a terminal panel 44 of bottom flap 24 folds into the interior of the box 10 and is engaged therein by two coating lateral flaps 38 of side panels 14 and 16.

If desired, for assisted engagement of bottom panel 24, terminal flap 44 may be provided with a slot 46 therein within which a tab 48 formed in coating elongate end 50 of front panel 18 may be engaged, as shown in FIG. 4.

Then, side flap 30 of cover panel 26 is folded over and glued to the surface of the cover panel 26 as shown.

The box 10 is now ready to receive an isolator element 52 therein. As shown, this embodiment of isolator element 52 comprises a corrugated cardboard base 53 having dimensions equal to the dimensions of back panel 12. Mounted on each lateral end of base 53 is a nearly square in cross section elongate block 54 of firm but compressible material, such as foamed polystyrene.

The dimension of the spacing between the blocks 54 is equivalent to the length of a video cassette, and the isolator element 52 is slid into the box 10 and may be fixed to the back panel 12 thereof, if desired, such as by gluing.

A video cassette (not shown) is then inserted, the cover panel 26 is brought over the front panel 18, the terminal flap 32 is folded over, and the tabs 34 are engaged in slits 36, forming the complete mailer 10 of FIG. 1.

It will be understood that the visible surfaces of the flaps and panels may bear advertising, etc. thereon and be laminated as well, although this is not to be construed as limiting. Also, in the preferred embodiment the visible surface of the back panel 12 serves as the mailing bearing address surface, with a return address being printed thereon, as desired.

As an alternative here, the rear panel 12 or the cover panel 26 could also be provided with a window 55 behind which could be secured a document bearing a mailing address.

Also, side flap 30 includes a terminal flap 56, which is secured to cover panel 26, forming a pocket 57 therebeneath within which further materials, as well as an address sheet could be placed. Further, to make removal of materials from the pocket 57 easier, a thumb notch 58 is cut into one edge 59 of the flap 30, as shown.

It will further be understood that the blank 11 is formed of thin cardboard which includes the various panels and flaps defined above separated, by score lines which define the various hinged connections between the panels and flaps.

Still further, it will be understood that the unique configuration of the blank 11 provides for printing on one surface only, which is less costly than two sided printing, while all visible surfaces of the box 10 will appear to be printed, upon construction thereof.

In FIGS. 5–8, a further embodiment of a video cassette mailer 60 is shown. In these Figures, flaps and panels similar to those of the first embodiment bear like numbers thereto, and, for the sake of brevity, only modified flaps and panels will be fully defined hereinafter.

As illustrated, the second embodiment of the box 60 and blank 62 therefor are slightly more complex.

In this respect, front panel 18 has been modified to include a terminal bottom flap 64 and the terminal flap 44 engaged to bottom panel 24 has been replaced by a depending panel 66 similar in dimension to cover panel 26. Depending panel 66 further includes a side flap 68 which is foldable over and engageable to depending panel 66, in a manner similar to that in which side flap 30 is folded over and engaged to cover panel 26.

The provision of the panel 66 and flap 68, it will be understood, increases printable area by approximately one third, with printing of the blank 62 still being only one sided.

Also, the panel 66 and flap 68 provide an extra double layer of isolation for one side of the video cassette.

In this respect, after front panel 18 is engaged to terminal flap 40, terminal bottom flap 64 thereof is now engageable to bottom panel 24, by gluing or the like. Depending panel 66, now with side flap 68 fixed thereto, is foldable over front panel 18, creating two layers of isolation thereover. Then, as described above, cover panel 26 with its engaged side flap 30, is brought over panel 66, and engaged to back panel 12, by engagement of tabs 34 into slits 36.

At times, a company may desire to receive a reply to the advertising, etc. it sends out. To accommodate ease of the recipient in producing such a reply, a slightly modified embodiment 70 of the mailer 10, as well as its corresponding blank 72, may be desired.

As shown in FIGS. 9–12, the provision of a mailable postcard 75 may be easily accommodated. In this respect, the postcard 75 may be formed as a panel 75, releasably depending from, such as for example, depending panel 66, as illustrated.

The postcard panel 75 could also be releasably engaged to another panel, and the embodiment disclosed herein is not to be construed as limiting.

In this embodiment 70, upon construction, the postcard 75 would be folded over the depending panel 66 first, and then the depending panel 66 would be brought over front panel 18, with closure continuing as previously described above.

Also, although the mailer 110 here is shown to accommodate a single cassette, this is not to be construed as limiting. In this regard, the mailer 110 is page sized and could in fact, because of its size, be provided with duplicated structures, for accommodating two cassettes, in side by side manner. Further, the mailer 110 could be made larger, as required, to accommodate an even greater number of cassettes therein. Obviously, the corresponding isolator element 114 could also be modified in similar manner.

As described above, the various video mailers and isolator elements of the present invention have a number of advantages, some of which have been described above and others of which are inherent in the invention.

Also, modifications may be proposed without departing from the teaching herein. Accordingly, the scope of the invention is only to be limited as necessitated by the accompanying claims.

I claim:

1. In combination with a video cassette, a video cassette mailer for protecting the video cassette received therein from damage during mailing thereof, the video cassette having a particular set of dimensions and the mailer comprising:

a box including at least a rectangular back panel having two short opposite ends and two longer ends, a side panel extending from each shorter end thereof, a front panel extending from one of said side panels, a top panel and a bottom panel each of which extend from one longer end of said back panel and a depending cover panel engaged to and extending from said top panel and which folds Over said front panel and is engaged in said folded over position by tabs thereon which are received in slits provided at a juncture of said back panel and said bottom panel and having at least one dimension thereof greater than a corresponding dimension the video cassette and having an undercut area along one end edge of one panel thereof, and an isolator element slidably and snugly received within said box and snugly engaging the video cassette in a manner to isolate a plurality of surfaces of the cassette from contact with the box, in cushioning manner.

2. The mailer of said claim 1 wherein said isolator element comprises a base panel having dimensions equal to those of said rear panel of said mailer.

3. The mailer of claim 2 wherein said base panel is rectangular and includes cushioning elements thereon lying along at least the length of shorter ends thereof.

4. The mailer of claim 3 wherein said cushioning elements are spaced from one another to accommodate a video cassette snugly therebetween.

5. The mailer of claim 4 wherein said base panel is made of corrugated paperboard.

6. The mailer of claim 5 wherein said cushioning elements are elongate, square in cross section, sections of foamed polystyrene.

7. The mailer of claim 6 wherein said cushioning elements of said isolator element are fixed to said base panel by glue.

8. The mailer of claim 7 wherein said base panel is fixed to said rear panel of said box by gluing.

9. The mailer of claim 8 wherein said top panel covers an opening into the box through which a video cassette slides.

10. The mailer of claim 9 wherein said front panel includes an undercut area therein for graspability of the cassette, the undercut area forming a continuation of the opening covered by the top panel.

11. The mailer of claim 10 wherein said cover panel includes a side panel engaged thereto in a manner to form a pocket therebetween.

12. The mailer of claim 11 further including a depending panel engaged to said bottom panel which folds over said front panel beneath said cover panel.

13. The mailer of claim 12 further including a side panel engaged to said depending panel which is fixed thereover.

14. The mailer of claim 13 further including a postcard panel dependingly engaged to said depending panel along a tear line.

15. The mailer of claim 1 wherein said isolator element has a front panel which includes at least one opening therein having dimensions equal to those of a video cassette.

16. The mailer of claim 15 wherein said opening is defined by depending tabs which fold downwardly into engagement with said base panel.

17. The mailer of claim 16 wherein said isolator element further includes two side panels, a top panel and a bottom panel.

18. The mailer of claim 17 wherein said front panel of said mailer includes at least one opening therein which is identical to that in the front panel of said isolator element and is defined by depending tabs.

19. The mailer of claim 18 wherein corresponding depending tabs of said mailer front panel are folded into engagement with the base panel of the isolator element as well.

20. The isolator element of claim 19 being made entirely of corrugated paperboard and including a planar rear panel, a planar bottom panel engaged to said rear panel, an open front panel comprising side tabs engaged to said bottom panel and including inner side flaps inwardly foldable into engagement with said rear panel, said side flaps being perpendicular to said rear panel and defining a space therebetween within which a video cassette maybe snugly accommodated, an open top panel comprising side tabs forming a continuation of the side tabs of said front panel, and a rear support panel engaged to said top panel and foldable in to a rear panel underlying position by engagement of a terminal tab thereon within a slit provided for same at a juncture of said rear panel and said bottom panel.

21. A blank for forming a video cassette mailer including at least a rectangular back panel having two short opposite ends and two longer opposite ends, a side panel hingedly engaged to and extending from each short end, a top panel and a bottom panel, a front panel hingedly engaged to and extending from one side panel, the other side panel including a depending tab, a cover panel hingedly engaged to said top panel which folds over said front panel and hingedly engages a terminal flap which folds over said bottom panel and engages said back panel to form a closed box.

22. The blank of claim 21 wherein said cover panel has a side flap hingedly engaged thereto which folds over and engages said cover panel to form a pocket therebetween.

23. The blank of claim 22 wherein said cover panel includes a terminal flap having at least one tab thereon, said tab being engaged within a slot for same at a juncture of said back panel with said bottom panel.

24. The blank of claim 23 wherein said bottom panel engages a depending panel which is sized and configured to fold over said front panel, beneath said cover panel.

25. The blank of claim 24 wherein said depending panel includes a side flap.

26. The blank of claim 25 wherein said depending panel further includes a depending postcard panel engaged thereto along a tear line.

27. The blank of claim 26 being made of cardboard.

28. The blank of claim 27 wherein said said front wall includes a recessed area, and recessed area is along one edge thereof.

29. The blank of claim 28 wherein said recessed area is centrally located.

30. The blank of claim 29 wherein said side flap of said cover panel includes a recessed area therein.

31. The blank of claim 30 wherein a pocket is created upon engagement of a free end of said side flap to said cover panel.

32. The blank of claim 31 wherein said cover panel side flap includes business card engaging notches therein.

33. The blank of claim 32 wherein said cover panel side flap includes a pamphlet engaging elongate slit therein.

* * * * *